US007839254B2

(12) United States Patent
Dinsmore et al.

(10) Patent No.: US 7,839,254 B2
(45) Date of Patent: Nov. 23, 2010

(54) TRANSFORMER WITH HIGH VOLTAGE ISOLATION

(75) Inventors: Mark Thomas Dinsmore, Sudbury, MA (US); David J. Caruso, Groton, MA (US)

(73) Assignee: Moxtek, Inc., Orem, UT (US)

( * ) Notice: Subject to any disclaimer, the term of this patent is extended or adjusted under 35 U.S.C. 154(b) by 34 days.

(21) Appl. No.: 12/328,687

(22) Filed: Dec. 4, 2008

(65) Prior Publication Data

US 2010/0141234 A1 Jun. 10, 2010

(51) Int. Cl.

| | |
|---|---|
| ***H01F 27/24*** | (2006.01) |
| ***H01F 21/02*** | (2006.01) |
| ***H01F 27/28*** | (2006.01) |
| ***H01F 17/04*** | (2006.01) |
| ***H01F 29/14*** | (2006.01) |
| ***G05F 1/32*** | (2006.01) |

(52) U.S. Cl. ..... 336/212; 336/145; 336/170; 336/182; 336/220; 336/221; 336/222; 323/335; 323/338

(58) Field of Classification Search ..... None
See application file for complete search history.

(56) References Cited

U.S. PATENT DOCUMENTS

| | | | | |
|---|---|---|---|---|
| 4,467,293 | A * | 8/1984 | Apel | 333/112 |
| 4,907,246 | A * | 3/1990 | Kleiner | 323/335 |
| 5,220,297 | A * | 6/1993 | Crowhurst | 333/32 |
| 5,523,939 | A * | 6/1996 | Stephenson | 363/59 |
| 5,539,369 | A * | 7/1996 | Selker et al. | 336/212 |
| 5,789,907 | A * | 8/1998 | Casagrande | 323/335 |
| 5,929,738 | A * | 7/1999 | Orlando | 336/180 |
| 6,215,386 | B1 * | 4/2001 | Gokita et al. | 336/182 |
| 6,239,668 | B1 * | 5/2001 | Menna et al. | 333/25 |
| 6,339,316 | B1 * | 1/2002 | Eguchi et al. | 322/59 |
| 6,777,835 | B1 * | 8/2004 | Sines | 310/64 |
| 7,282,868 | B2 * | 10/2007 | Ushijima et al. | 315/277 |
| 7,319,435 | B2 | 1/2008 | Rauch | |
| 2008/0159480 | A1 * | 7/2008 | Wraight et al. | 378/89 |

* cited by examiner

*Primary Examiner*—Anh T Mai
*Assistant Examiner*—Mangtin Lian
(74) *Attorney, Agent, or Firm*—Thorpe North & Western LLP

(57) ABSTRACT

A high-voltage isolation transformer utilizing balun cores for transferring an alternating current signal from a first circuit to an output circuit, and a high voltage generator, such as a Cockcroft-Walton multiplier to apply a high direct current voltage bias with a high degree of voltage isolation between the first circuit and the output circuit. Multiple balun core transformers can be used in order to reduce the voltage rise between each individual transformer.

9 Claims, 4 Drawing Sheets

TRANSFORMER WITH HIGH VOLTAGE ISOLATION

FIELD OF THE INVENTION

The present invention relates to transformers with high-voltage isolation.

BACKGROUND

It is difficult, in an electrical transformer, to insulate a very low voltage primary circuit from a very high voltage secondary circuit due to the voltage difference between the two circuits. Another problem with some high voltage isolation transformers is the generation of significant electromagnetic waves at an amplitude and frequency that may interfere with sensitive electronic components. For example, some handheld x-ray fluorescence (XRF) spectrometers require high voltage isolation transformers to provide a small AC signal at a large negative DC potential for the thermionic cathode of an x-ray tube. Electromagnetic waves from these transformers can interfere with an x-ray signal received by an x-ray detector in the XRF spectrometer.

Optimal operation of a transformer is typically at the transformer's resonant frequency. In XRF analyzers using transformers with torroidal shaped cores, electromagnetic waves emitted at the core's resonant frequency may significantly interfere with the operation of the x-ray detector. In addition, the shape of a toroidal transformer can result in a high level of electromagnetic interference (EMI). Shielding and circuit design are often used to mitigate the electromagnetic interference of the detector, but eliminating this interference with circuit design and shielding, especially in the small space available in a relatively small handheld XRF spectrometer, can be difficult.

A toroid shaped core, made of ferromagnetic material, may be used in a high voltage isolation transformer. For example, in handheld XRF spectrometers, the primary windings of the transformer have a relatively low voltage, typically around 10 volts rms AC. The secondary windings carry an alternating current, induced by the AC signal on the primary windings. The secondary windings also have a very large bias voltage of around negative 50,000 volts compared to the primary windings. This bias voltage is generated primarily by a high voltage power supply that is used to apply the bias voltage to the secondary windings. It is very difficult to effectively insulate circuits with such a large voltage difference.

High voltage isolation transformers having a toroid shaped core can have stringent design and manufacturing requirements. To isolate the two widely disparate voltages, of the primary and secondary windings, thick insulation is typically applied to the transformer core, the wire, or both wire and core. Insulation is used that can maintain its integrity and be free of cracks in order to avoid current leakage between the primary and secondary windings. If the bulk of the insulation is on the core, the insulation can crack due to thermal expansion caused by the heating and cooling of the core. One cause of the insulation cracks, during these temperature fluctuations, is a mismatch of the coefficient of thermal expansion (CTE) of the core compared with the CTE of the insulation. Creating this match can be a difficult design challenge. Applying crack-free insulation is often a difficult manufacturing challenge. Thicker insulation can be more difficult to manufacture, without insulation defects, than thinner insulation.

SUMMARY OF THE INVENTION

A transformer circuit with high voltage isolation is disclosed. The transformer circuit includes a first circuit configured to carry an alternating current signal at a low voltage level. The first circuit is looped through at least two holes in a balun core to act as a primary winding of the transformer circuit. An output circuit is looped through at least two holes in the balun core to act as a secondary winding of the transformer circuit. The output circuit is electrically coupled to a high voltage direct current signal source to provide a direct current bias to the alternating current signal with a high level of voltage isolation between the first circuit and the output circuit. More than one balun core may be used in series to allow a more gradual increase in voltage.

There has thus been outlined, rather broadly, various features of the invention so that the detailed description thereof that follows may be better understood, and so that the present contribution to the art may be better appreciated. Other features of the present invention will become clearer from the following detailed description of the invention, taken together with the accompanying claims, or may be learned by the practice of the invention.

DETAILED DESCRIPTION

Definitions

Figure 2:
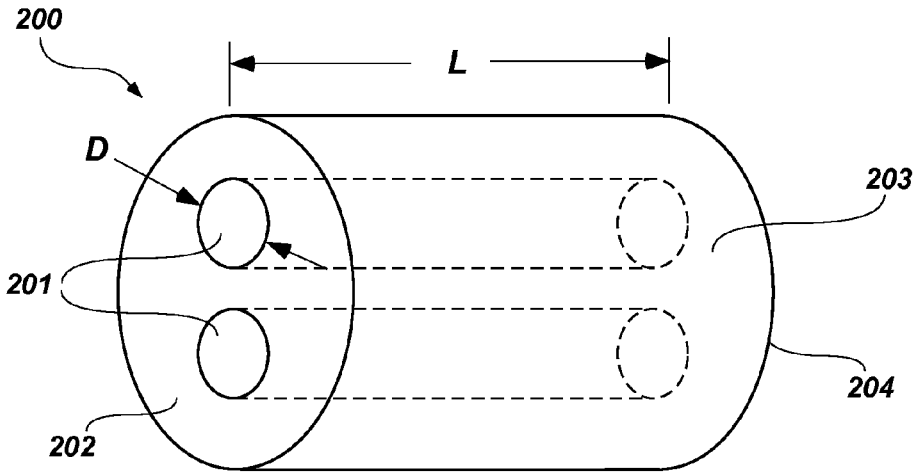
FIG. 2 is a balun core for use in a transformer.

A balun transformer core, balun core, or balun, as defined in this application is a transformer core with at least two holes, as shown in one exemplary embodiment illustrated in FIG. 2, indicated generally at 200. The balun has a top surface 202, a bottom surface 204 and a side surface 203. Normally the shape of the top and bottom surfaces is circular or elliptical, but they can also be square, triangle, rectangular, or other shape. The benefit of a circular or elliptical shape of these surfaces, as shown in FIG. 2, is that it allows a smooth side surface 203 and fewer edges where other components and insulation can be cut or where corona stress may occur. The balun illustrated in FIG. 2 includes two holes 201 which extend from the top surface 202 through the balun to the bottom surface 204. The balun may include more than two holes. The length L of the balun is normally longer than the hole diameter D, to allow more distance for electrically coupling a wire that passes through the hole to the core. Usually the length L is at least twice the hole diameter D. Balun cores may be found and purchased under the name "Wideband Multi-Aperture Balun Cores".

AC and DC, as used in this application have their normal meanings of Alternating Current and Direct Current. EMI is the acronym for Electromagnetic Interference and has its usual definition of electromagnetic interference with the proper operation of an electronic circuit.

XRF is an acronym for x-ray fluorescence and is the emission or fluorescence of x-rays from a material that has been excited by bombarding the material with X-rays or gamma rays. XRF spectrometers can provide an x-ray source for bombarding a sample with x-rays and also have a detector for quantifying the amount and energy of x-rays fluoresced by the sample. XRF spectrometers can be used for analyzing what elements a material is made of.

FEP is an acronym for fluorinated ethylene propylene. FEP is a type of insulating material with a high dielectric strength.

Description

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

A high voltage isolation transformer that interferes less with sensitive electromagnetic components is relatively easy to manufacture, and is reliable. This may be accomplished by using A transformer split into multiple transformer cores can be used to reduce high voltage isolation problems. The use of multiple cores also reduces the DC stress across each core and reduces the required amount of insulation at each core. Transformer cores with thinner insulation are easier to manufacture. Further improvement is realized with the use of a balun core or multiple balun cores as the transformer cores. Balun cores have a much wider bandpass than toroid cores, and can thus be driven at a high enough frequency to be outside the sensitivity range of the X-ray detector electronics. Use of a balun core instead of a toroid shape, or many other core shapes, results in a reliable, easy to manufacture design, and less EMI. The EMI emitted by the balun core is also easier to shield because this EMI is more directional than the EMI emitted by a toroid core.

One purpose of the transformer, or transformers in a multiple transformer design, can be to transfer an AC signal from one circuit to another circuit. A high voltage generator can be used to create a large bias voltage between the circuits. The high voltage generator, such as a Cockcroft-Walton Multiplier, can generate a high voltage from a low voltage, in a compact space. Some high voltage generators, such as a Cockcroft-Walton Multiplier, can provide a voltage rise in steps. Circuits external to such high voltage generators can connect at each of these different voltage steps, providing a series of high voltage access points of increasing voltage. The Cockcroft-Walton Multiplier is especially valuable in handheld, battery-operated XRF spectrometers, because of limited space and limited available power in this equipment.

For example, if the bias voltage rise occurs across two transformers, only half of the total voltage rise occurs at each transformer, thus the insulation thickness required at each transformer is significantly less than what is required for a single transformer. The voltage rise across each transformer may be created by using a Cockcroft-Walton multiplier. The primary windings of the first transformer, called a first circuit, carry a low voltage AC signal. The secondary windings of the first transformer, called an intermediate circuit, are also the primary windings of the second transformer. This intermediate circuit is attached to a mid-level voltage point on the high voltage generator. The secondary windings of the second transformer, called the output circuit, are connected to the highest voltage point on the high voltage generator. The output circuit provides an AC signal at a high bias voltage to the load. The high DC bias can be either a large negative bias or a large positive bias. Generally, the intermediate windings of the transformers are limited to one turn, and the majority of the HV insulation is provided on these windings. For example, the intermediate winding can be made of wire with thick FEP insulation approximately 0.1" in diameter that is capable of insulating more than 30 kV.

For example, in a handheld XRF spectrometer, the first circuit carries an AC signal at around 10 volts rms. The AC signal is induced in the intermediate circuit and the connection to the high voltage generator enables a DC bias to be maintained between the first circuit and the intermediate circuit at around negative 25,000 volts DC. The AC signal is then induced in the output circuit. A separate connection to the high voltage generator enables a bias between the intermediate circuit and the output circuit at around negative 25,000 volts to be maintained, for a total bias between the first circuit and the output circuit of around negative 50,000 volts DC.

With two transformer cores, the voltage rise at each transformer is only 25,000 volts, allowing insulation rated at 30,000 volts to be used. Having the two cores allows the use of wire with an insulation rating of 30,000 volts to be used while achieving 50,000 volts of isolation between the first circuit and the output circuit and enabling a small AC signal, such as the 10 volt rms signal used in the example above, to be applied to the highly biased signal. The number of primary, secondary, intermediary, or output windings may be changed if a lower or higher AC signal is desired.

In an XRF spectrometer, the thermionic cathode normally operates at a very large negative DC potential relative to the anode. For example, the anode may approximate ground voltage and the cathode may be about negative 50,000 volts. This large negative potential results in acceleration of electrons from the cathode to the anode. A small AC signal, typically less than 10 volts AC rms, can also be applied to the cathode. The AC signal is used to heat up the cathode for improved electron emission.

More transformers may be used in series, allowing an even more gradual increase in voltage at each stage, or a higher overall voltage rise with the same increase in voltage at each stage, while maintaining the original AC signal. Different high voltage generator access points, with each successive access point higher in voltage than the previous, are used to connect to each of the intermediate circuits and to the output circuit. Each intermediate circuit is the secondary winding of the previous transformer and the primary winding of the succeeding transformer. The first intermediate circuit is connected to the lowest high voltage generator access point. The next intermediate circuit is connected to a higher, high voltage generator access point. Each successive intermediate circuit is connected to a high voltage generator access point having a greater voltage than the previous intermediate circuit, until, at the end, the output circuit is connected to the highest high voltage generator access point. A series of transformers in high voltage isolation applications can provide beneficial space savings. The high voltage generator is typically relatively long. A chain of transformers is also usually relatively long and can conveniently extend through space in the equipment adjacent to the high voltage generator.

The transformer core is a means for inducing alternating current in the secondary windings of a transformer. The core aids in efficient transfer of the electrical signal from the primary winding to the secondary winding in a transformer. Many cores shapes are available and well known in the art, such as pot, planar, economical flat design (EFD), ER, EP, toroid, bar, rod, C, U, E, and F shaped cores. In one embodiment of the present invention, two balun cores are used as the transformer core rather than a toroid or other shaped core. A balun core is described in U.S. Pat. No. 7,319,435, incorporated herein by reference.

A balun core can have a higher resonant frequency than a toroidal shaped core, allowing a higher drive frequency and thus smaller balun cores to be used. In some XRF analyzers, the toroidal transformers are typically operated at their resonant frequency—around 100 kHz. In experimental XRF analyzers, the balun core transformers are operated at their resonant frequency, which can be around 1 MHz or higher. Presently, the experimental XRF analyzers with balun cores are operated at 2.5 MHz. The higher resonant frequency of the balun core can cause significantly less XRF detector interference.

A transformer having balun cores can provide reduced leakage inductance and better coupling as compared with other core types. For example, a torroidal shaped core can produce lower frequency EMI due to the lower resonant frequency of the toroid core. This lower frequency EMI can have a more adverse effect on XRF detectors than the higher frequency EMI that occurs at the higher resonant frequency of the balun core. The balun core can have a maximum bandwidth and lower power loss at high frequency, allowing operation of the balun core transformers in a range that produces EMI at a frequency that is less detrimental to an XRF detector. The balun may be made of any standard transformer core material, such as powdered iron, steel, or ferrite, depending on the frequency of operation. Other materials may also be used. Core material affects performance and should be a design consideration. Presently, ferrite is the preferred core material. The actual material can be selected to be suitable to the specific application and is not critical to the present invention.

Figure 4:
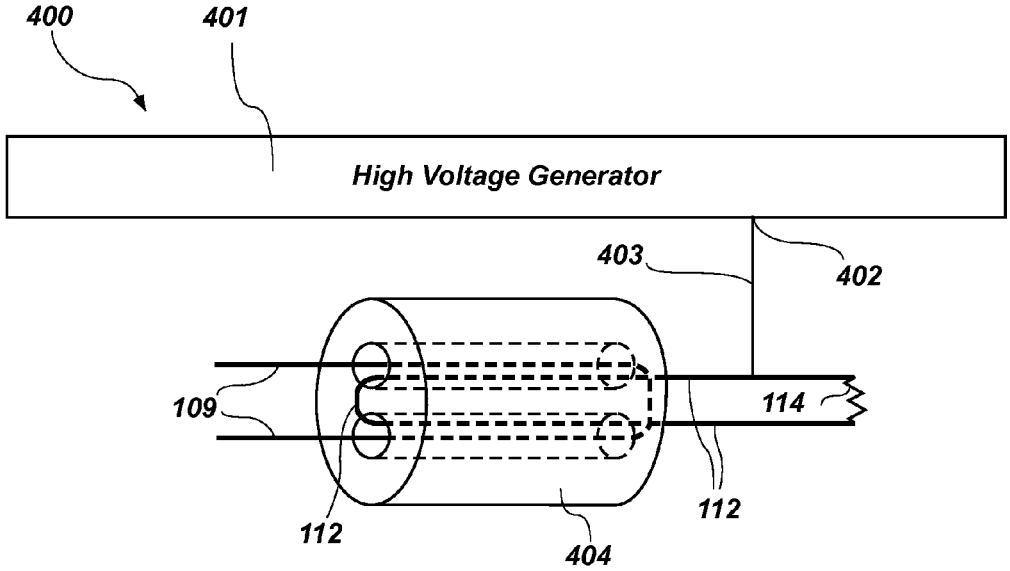
FIG. 4 shows a high voltage isolation transformer with a single balun core.

FIG. 4 shows one exemplary embodiment of a high voltage isolation transformer, indicated generally at 400. An electrical circuit 109, called a first circuit, can carry an alternating current at low voltage. The first circuit is looped in through one hole and out through the other hole of the balun core 404 and is the primary winding. The first circuit can be looped one time or many times. An AC signal is induced in a secondary winding 112. The secondary winding 112, or output circuit, can carry an AC signal at a relatively high DC bias voltage to a load 114. The high voltage isolation is generally accomplished by using a single turn secondary with sufficient high voltage insulation to withstand the designed voltage stress per stage. A high voltage generator 401 can provide a very high voltage bias at access point 402 and can be connected to the output circuit 112 through connection means 403. The connector, in this and other embodiments, can be any standard electrical wire with appropriately rated insulation. The connections between wires or circuits can be any standard high-voltage electrical connection. Solder is preferred. In this and other embodiments, the output circuit can be the cathode of an x-ray tube, or some other circuit that uses an alternating current at a high DC bias voltage.

The high voltage generator in the embodiment above and in later described embodiments may be a Cockcroft-Walton (CW) multiplier. This is a type of voltage multiplier that is used to convert alternating current or pulsing DC electrical power from a low voltage level to a higher DC voltage level. It is comprised of a voltage multiplier ladder network of capacitors and diodes to generate high voltages. The CW multiplier is well known in the art. A more detailed description is provided below with reference to FIG. 6.

Figure 1:
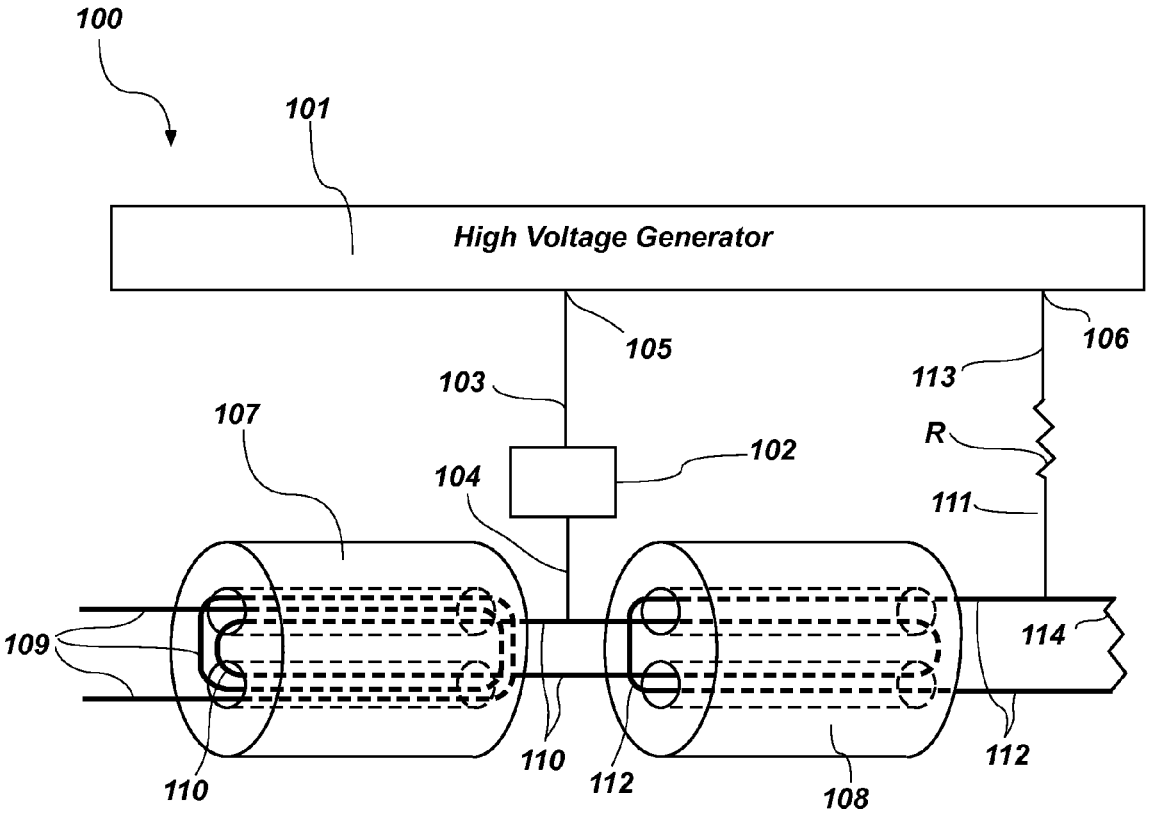
FIG. 1 shows a high voltage isolation transformer in which the transformer is split into two cores.

FIG. 1 shows one exemplary embodiment of a high voltage isolation transformer, which is split into two transformer cores, and is indicated generally at 100. An electrical circuit 109, called a first circuit, carries an alternating current at a relatively low voltage, such as around 10 volts. This first circuit is looped in through one hole and out through the other hole of the first balun core 107 and acts as the primary winding of the first balun core 107. The first circuit can be looped one time or many times. An AC signal is induced in a secondary winding 110 of the first balun core 107. This first balun core secondary winding 110 acts as an intermediate circuit and is the primary winding for a second balun core 108. The intermediate circuit 110 induces an AC signal in an output circuit 112, which acts as a secondary winding, or output circuit for the second balun core 108. The intermediate circuit 110 can be looped through the first balun core 107 once or multiple times, although it usually consists of one turn of high voltage insulated wire. The intermediate circuit 110 can also be looped through the second balun core 108 once or multiple times. The output circuit 112 may be looped through the second balun core 108 once or multiple times. Output circuit 112 may be connected to load 114. This load may be a thermionic cathode in an x-ray tube. The x-ray tube may be used in an XRF spectrophotometer. The ratio of input to output voltage can be modified by adjusting the ratio of the number of turns of the first primary to the number of turns of the last secondary. This is useful, for instance, in matching the drive electronics rms voltage to the voltage required by the filament of the X-ray tube.

A high voltage generator 101, with a mid-level voltage access point 105 and a high-level voltage access point 106, can provide a high DC voltage bias. The mid-level voltage access point 105 can be connected to an optional circuit isolation means 102 via wire 103.

A circuit isolation means 102 is used in the circuit between the high voltage access points 106 of the high voltage generator and the intermediate circuit 110. The circuit isolation means may be a resistor, a metal-oxide varistor, or a spark gap or other similar device. The circuit isolation means isolates radio frequency signals in the transformer network from the high voltage generator. The circuit isolation means also creates a bias voltage reference for the intermediate circuit without creating current path between the high voltage generator and the intermediate circuit.

The circuit isolation means 102 can be connected to the intermediate circuit 110 via wire 104. However, the high voltage isolation transformer can function without the circuit isolation means 102. The circuit isolation means 102 is optional in this and other embodiments described later. If circuit isolation means 102 is not used, then wire 103 is connected to wire 104 or wires 103 and 104 are one continuous wire. With or without the circuit isolation means 102, the mid-level access point 105 provides a voltage, that may be approximately half of the voltage at access point 106, to the intermediate circuit 110. High-level voltage access point 106 is connected to the output circuit 112 via wire 111, resistor R and wire 113. Although a resistor R is normally used, the circuit can function without this resistor. The access point 106 can provide a very high voltage bias for the output circuit 112.

Figure 3:
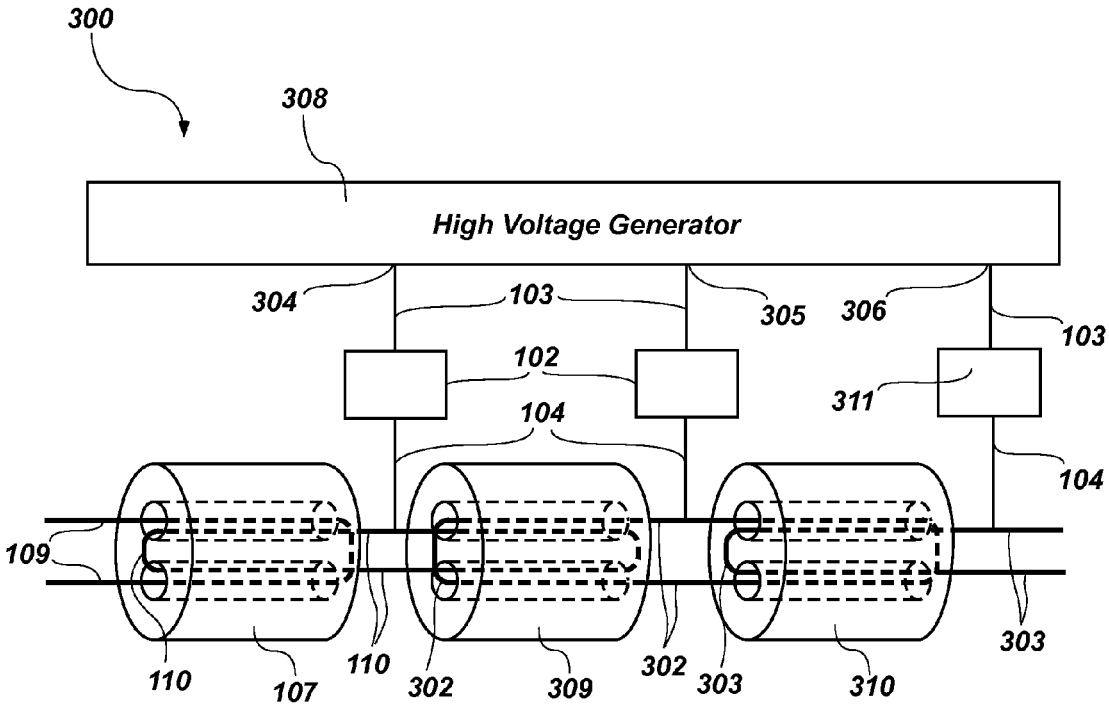
FIG. 3 shows a high voltage isolation transformer in which the transformer is split into at least three cores.

FIG. 3 shows a high voltage isolation transformer, which is split into at least three transformer cores, and is indicated generally at 300. An electrical circuit 109, called a first circuit, carries an alternating current at a relatively low voltage. This first circuit is looped in through one hole and out through the other hole of a first balun core 107 and is the primary winding of the first balun core 107. The first circuit can be looped one time or many times. An AC signal is induced in a secondary winding 110 of the first balun core 107. This first balun core secondary winding 110 is an intermediate circuit and is the primary winding for a second balun core 309. The intermediate circuit 110 induces an AC signal in a second intermediate circuit 302, which is a secondary winding for the second balun core 309. The second intermediate circuit 302 is a primary winding for a third balun core 310, and induces an AC signal in circuit 303. Circuit 303 may be an output circuit or may be another intermediate circuit. This same configuration can continue, with more balun cores and an intermediate circuit looped between each pair of balun cores in the sequence. The circuit exiting the final balun core is the output circuit.

In deciding how many balun cores to be used, the possible benefit of a smaller voltage difference between adjacent circuits can be balanced against the possible challenges of a longer transformer and overall power loss. Having more balun cores, with a smaller voltage difference between adjacent circuits, allows reduced insulation to be used on the wires. A chain of more balun cores, however, requires more space. Also, there is a power loss, between the primary and secondary windings, across each successive balun core. The possible benefit of reduced insulation can be weighed against possible disadvantages of a longer chain of balun cores and the power loss across each balun core.

Normally, only one intermediate circuit connects two balun cores, but more may be used. Any of the circuits may loop through a balun core once or many times, depending on the desired amplitude of the AC signal at the output circuit relative to the first circuit 109.

A high voltage generator 308, with multiple voltage access points provides a high DC voltage bias to the AC signal. Each successive high voltage access point in the series, moving from left to right across FIG. 3, is a higher voltage than the previous access point. Typically, there would be an approximately equal voltage difference between any access point and the preceding or succeeding access point. In this exemplary embodiment, access point 304 is the lowest voltage, 305 is the next highest, and 306 is the next highest. If 306 is the last access point, as shown in this embodiment, then it would be the highest voltage access point. If 306 is not the last access point, then there can be a subsequent, higher voltage access point. The final access point is typically the highest desired voltage. If the change in voltage at each balun core is substantially equal, then the approximate difference in voltage between any two access points is equal to the highest voltage access point divided by the total number of access points. Alternatively, one or more balun cores may provide a greater change in voltage than other cores in the series.

All voltage access points, except the final access point, may be connected to an optional circuit isolation means 102 (described above) with a wire 103. The circuit isolation means 102 can be connected to the transformer winding by another wire 104. In FIG. 3, if the circuit 303 is an output circuit, then 311 is a resistor. If circuit 303 is an intermediate circuit, 303 is a circuit isolation means, such as a metal-oxide varistor.

The high voltage isolation transformer 300 enables a large DC bias to be applied to an AC signal while maintaining high voltage isolation between the first circuit 109 and the output circuit 306. Implementing the circuit in steps allows a lower change in bias between the balun cores, thereby enabling thinner insulation to be used. The use of thinner insulation reduces costs and decreases the size of the overall circuit.

High voltage isolation transformers are relatively easy to make. The balun cores may be purchased from numerous sources. Wire can be selected to have a proper insulation rating for the planned voltage difference between the primary winding and the secondary winding.

In one exemplary embodiment having a two balun-core isolation transformer, the intermediate circuit can include most of the insulation. This intermediate circuit may only be wound once through each balun core, due to the thickness of this insulation. Fluorinated ethylene propylene (FEP) can be used as insulation for the intermediate circuit. FEP can also be used as insulation for the other circuits. Alternatively, another material may be used.

Figure 5:
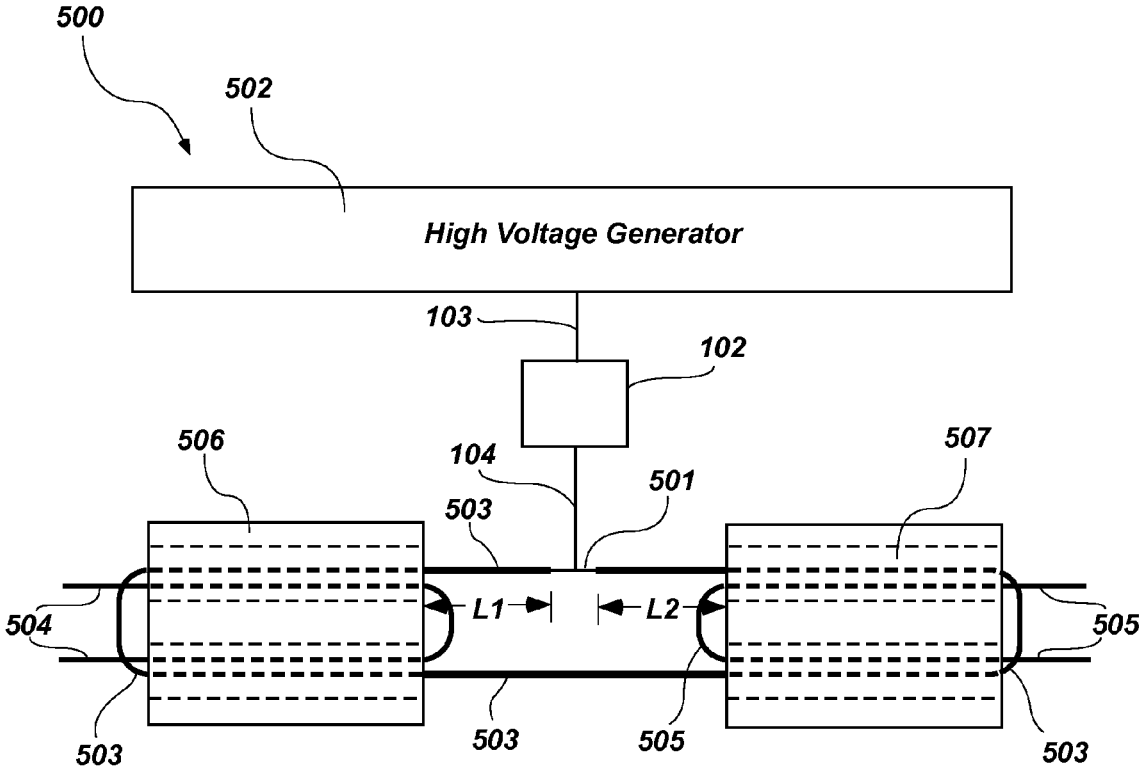
FIG. 5 shows the high-voltage connection point on an intermediate circuit of a high voltage isolation transformer.

FIG. 5 illustrates an example of a connection point on an intermediate circuit 501 and is shown generally at 500. In one embodiment, the connection 501 can be made from any intermediate circuit 503 to the high voltage generator 502, at a mid point between the two balun cores on each end of the intermediate circuit. In other words, it is preferred that distance L1 is approximately equal to distance L2 to maximize the distance from the insulation opening to the balun core. This is especially important if the bulk of the insulation is on the intermediate circuit 503 and a reduced amount of insulation is located on the primary winding 504 of the previous balun core 506 and the secondary winding 505 of the succeeding balun core 507. With minimal insulation on the primary winding 504 of the previous balun core 506, the balun core voltage will approximate the voltage of the primary winding 504 of that core. With minimal insulation on the secondary winding 505 of the succeeding balun core 507, the succeeding balun core voltage will approximate the voltage of the secondary winding 505 of that core. To avoid current flow along the surface of the insulation, from the opening in the intermediate circuit 501 to either balun core 506 or 507, the distance L1 or L2 in centimeters should be approximately equal to 0.00005 multiplied by the voltage potential between the intermediate circuit 503 and the balun core. For example, if there is a voltage difference of 25,000 volts between the intermediate circuit 503 and the first balun core 506, then the distance between the connection point 501 and the first balun core 506, distance L1, should be approximately 1.25 centimeters.

Figure 6:
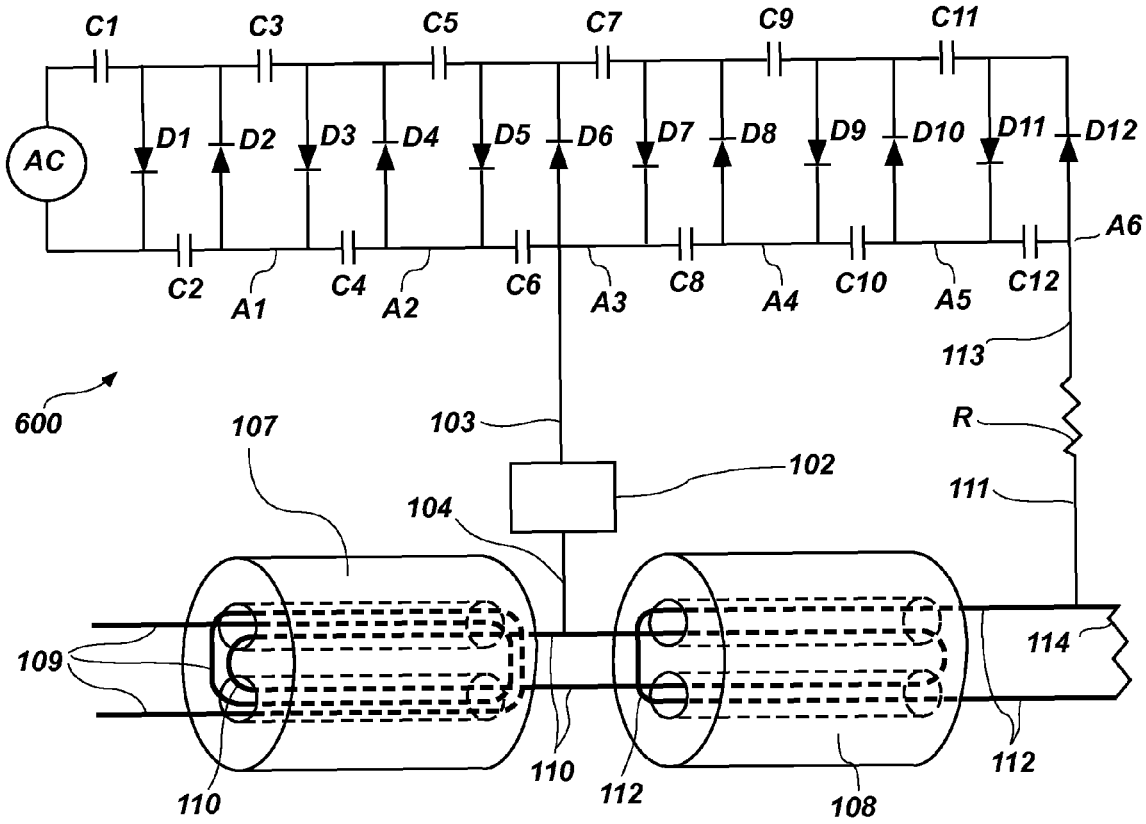
FIG. 6 shows a Cockcroft-Walton multiplier circuit connected to a high voltage isolation transformer in which the transformer is split into two cores.

FIG. 6 shows an example of a high voltage isolation transformer connected to a Cockcroft-Walton multiplier, and is indicated generally at 600. An AC supply can provide alternating current to the Cockcroft-Walton multiplier. Capacitors C1 through C12 are shown along with diodes D1 through D12 and access points A1 through A6. The amplitude and frequency of the alternating current, the size and type of diodes and capacitors may be selected as needed by a particular design to provide the desired DC bias to the AC signal in the transformer circuit with a high level of voltage isolation. Two consecutive capacitors and two consecutive diodes, for example, capacitors C1 and C2 and diodes D1 and D2 comprise a Cockcroft-Walton multiplier stage. Six Cockcroft-Walton multiplier stages are shown in FIG. 6. More stages may be added to further increase the voltage. Connection to the transformer circuits may be made at any of the access points.

It is to be understood that the above-referenced arrangements are only illustrative of the application for the principles of the present invention. Numerous modifications and alternative arrangements can be devised without departing from the spirit and scope of the present invention. While the present invention has been shown in the drawings and fully described above with particularity and detail in connection with what is presently deemed to be the most practical and preferred embodiment(s) of the invention, it will be apparent to those of ordinary skill in the art that numerous modifications can be made without departing from the principles and concepts of the invention as set forth herein.

We claim:

1. A transformer circuit with high voltage isolation comprising:

a) a sequence of at least two balun cores comprising a first balun core and a second balun core;

b) a first circuit operable to carry an alternating current signal at a low voltage;

c) the first balun core having at least two holes through the core;

d) the first circuit looped through the at least two holes in the first balun core at least one time, as a primary winding of a first transformer;

e) an intermediate circuit looped through the at least two holes in the first balun core at least one time, as a secondary winding of the first transformer, wherein the intermediate circuit is coupled to a mid-level on a direct current signal source;

f) the second balun core having at least two holes through the core;

g) the intermediate circuit looped through the at least two holes in the second balun core at least one time, as a primary winding of a second transformer;

h) an output circuit looped through the at least two holes of the second balun core at least one time, as a secondary winding of the second transformer, wherein the output circuit is coupled to a high voltage direct current signal source to provide a direct current bias to the alternating current signal with a high level of voltage isolation between the first circuit and the output circuit, wherein the high voltage generator provides a direct current bias greater than 1000 volts to the alternating current signal.

2. A transformer circuit with high voltage isolation, as in claim 1, wherein the direct current signal source is a Cockcroft-Walton multiplier configured to provide a mid-level direct current signal to the intermediate circuit and a high voltage direct current signal to the output circuit.

3. A transformer circuit with high voltage isolation, as in claim 2, wherein the Cockcroft-Walton multiplier mid-level voltage direct current signal is connected to the intermediate circuit through a circuit isolation device.

4. A transformer circuit with high voltage isolation, as in claim 3, wherein the circuit isolation device is a metal-oxide varistor.

5. A transformer circuit with high voltage isolation, as in claim 1, further comprising insulation configured to substantially cover at least one of the first circuit, the intermediate circuit, and the output circuit, wherein the insulation is formed of fluorinated ethylene propylene.

6. A transformer circuit with high voltage isolation, as in claim 1, further comprising a thermionic cathode of an x-ray tube coupled to the output circuit to act as a load on the output circuit.

7. A transformer circuit with high voltage isolation, as in claim 6, wherein the x-ray tube is used in an x-ray fluorescence analyzer.

8. A transformer circuit with high voltage isolation comprising:

a) a sequence of at least three balun cores, in which there is a first balun core, at least one intermediate balun core, and a final balun core, wherein each of the balun cores includes at least two holes through each core;

b) a sequence of circuits, in which there is a first circuit, at least two intermediate circuits, and an output circuit, and the total number of circuits is equal to the total number of balun cores plus one;

c) the first circuit operable to carry an alternating current signal at a low voltage and the first circuit looped through the at least two holes in the first balun core at least one time, as a primary winding of a first transformer;

d) a first intermediate circuit looped through the at least two holes in the first balun core, as a secondary winding of the first transformer, and looped through the at least two holes of a second balun core at least one time, as a primary winding of a second transformer;

e) wherein each of the intermediate balun cores is connected to a succeeding balun core by an intermediate circuit that is looped through the at least two holes in each of the intermediate balun cores at least one time;

f) wherein the final balun core is connected to the previous, intermediate balun core by an intermediate circuit that is looped through each of the at least two holes at least one time in the final and intermediate balun cores;

g) wherein the output circuit is looped through the at least two holes in the final balun core at least one time;

h) a means for providing a sequence of high voltage access points for the circuits, wherein:

1. a number of high voltage access points is equal to a number of intermediate circuits plus one;
2. a highest high voltage access point has a voltage higher than any other high voltage access point;
3. a first high voltage access point has a voltage that is approximately equal to a voltage of the highest high voltage access point voltage divided by the number of high voltage access points;
4. a voltage at each successive high voltage access point is greater than a voltage at a previous high voltage access point; and i) the first intermediate circuit is connected to the first high voltage access point, and each succeeding intermediate circuit is connected to a next corresponding high voltage access point, such that there is an increase in voltage at each successive intermediate circuit, and the highest high voltage access point is connected to the output circuit to provide a direct current bias to the alternating current signal at the output circuit with a high level of voltage isolation between the first circuit and the output circuit, wherein the high voltage generator provides a direct current bias greater than 1000 volts to the alternating current signal.

9. A transformer circuit with high voltage isolation, as in claim 8, wherein a difference in voltage between each high voltage access point and the succeeding high voltage access point is approximately equal to the voltage of the highest high voltage access point divided by the number of high voltage access points.

* * * * *